United States Patent [19]

Duncan et al.

[11] 4,289,714

[45] Sep. 15, 1981

[54] FUEL MANIFOLD FOR OVAL TRACK RACING CARS

[76] Inventors: Jimmie D. Duncan, 626 E. Chevy Chase Dr.; Ben T. Ryan, 1335 E. Harvard St., both of Glendale, Calif. 91205

[21] Appl. No.: 97,154

[22] Filed: Nov. 26, 1979

[51] Int. Cl.[3] ..... F02M 5/02

[52] U.S. Cl. ..... 261/34 R; 137/561 A; 137/590; 261/72 R; 261/DIG. 50

[58] Field of Search ..... 261/DIG. 50, 72 R, 34 R; 137/590, 561 A

[56] References Cited

U.S. PATENT DOCUMENTS

| | | | |
|---|---|---|---|
| 2,193,466 | 3/1940 | Raymond | 137/590 |
| 2,628,826 | 2/1953 | Worden | 261/DIG. 50 |
| 2,635,625 | 4/1953 | Moseley et al. | 261/DIG. 50 |
| 2,875,990 | 3/1959 | Gretz | 261/DIG. 50 |
| 2,973,947 | 3/1961 | Sterner | 261/34 R |
| 3,207,490 | 9/1965 | Sterner et al. | 261/DIG. 50 |
| 3,372,912 | 3/1968 | Benmore | 261/DIG. 50 |
| 3,704,723 | 12/1972 | Wheaton et al. | 137/561 A |
| 4,126,058 | 11/1978 | Shelby et al. | 137/561 A |

FOREIGN PATENT DOCUMENTS

| | | | |
|---|---|---|---|
| 732064 | 6/1955 | United Kingdom | 261/DIG. 50 |

OTHER PUBLICATIONS

Webster's Seventh New Collegiate Dictionary, Apr. 1965, pp. 124 and 272.

*Primary Examiner*—Tim R. Miles
*Attorney, Agent, or Firm*—Harlan P. Huebner

[57] ABSTRACT

A removable manifold for use with a high performance carburetor having a plurality of jets for supplying separate barrels of the carburetor with liquid fuel from a reservoir, the manifold being in the reservoir extending between and encapsulating the jets to generally equalize the flow of fuel from the reservoir to each jet, regardless of the angle of the fuel level in the reservoir.

5 Claims, 7 Drawing Figures

FIG. 1.
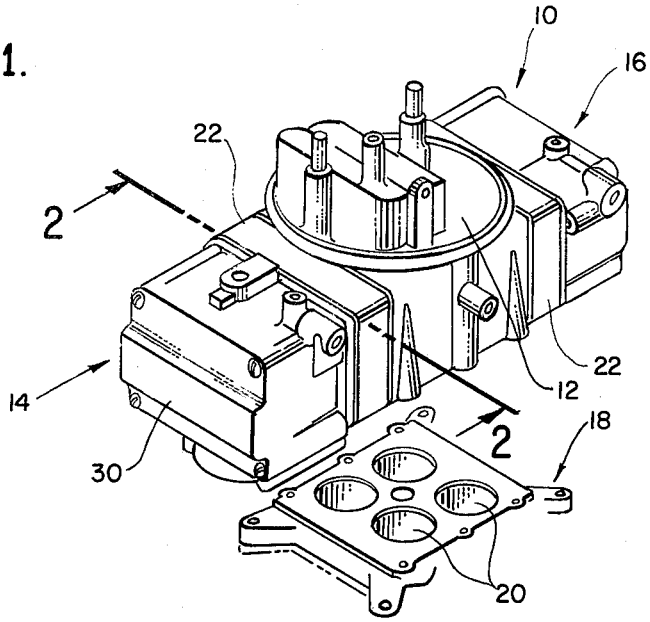
FIG. 2.
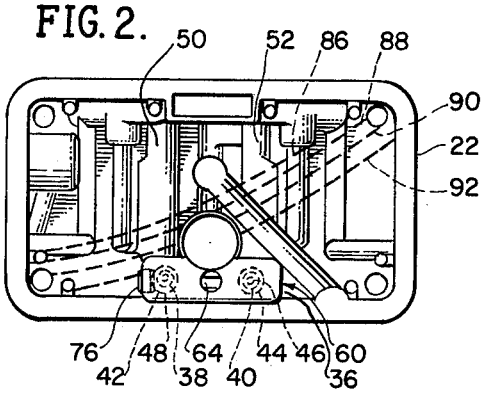
FIG. 3.
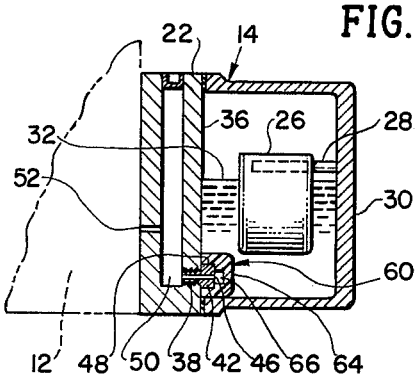
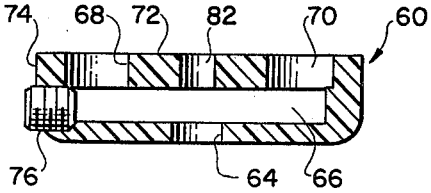
FIG. 6.
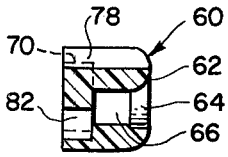
FIG. 7.
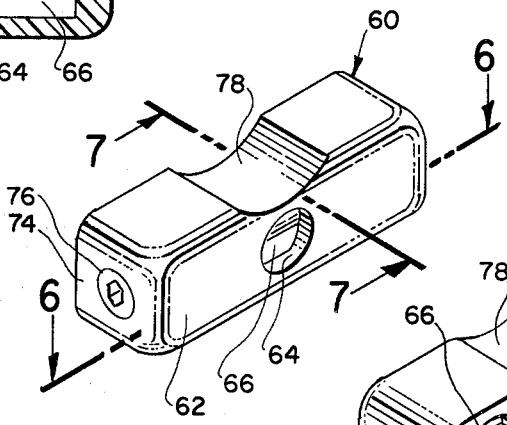
FIG. 4.
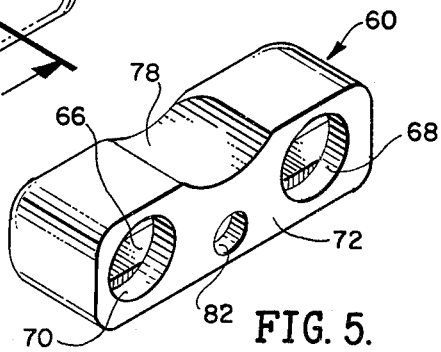
FIG. 5.

FUEL MANIFOLD FOR OVAL TRACK RACING CARS

BACKGROUND OF THE INVENTION

The invention relates to carburetion of liquid fuel in oval track racing cars. High performance carburetors for racing automobiles typically have four barrels. In a four barrel carburetor there are two fuel reservoirs, and each reservoir typically feeds fuel to two individual jets, each jet being for one barrel.

In oval track racing there are tremendous outward forces which cause the angles of levels of fuel in the reservoirs to frequently change with respect to the horizontal. The jets remain at the same relative horizontal level and as the fuel angle changes the pressure of the fuel entering the individual jets changes. That is, as the fuel lowers with respect to one jet and raises with respect to another jet, the pressure to the first jet is lowered and the pressure to the second jet is raised, whereby the flow to the first will be lean and the flow to the second will be rich. This is typically referred to as inside bank leanness and outside bank richness. This unequal supply of fuel to the various jets reduces the efficiency and speed of the engine.

In the prior art various methods have been used to attempt to remedy the above problem but they have been unsuccessful. For example, the sizes of the jets have been varied so that when the banking has the greatest effect the pressure in the amount of fuel flowing through the jets is the same, but when the car is on the straightaway, then the fuel flow is unequal.

Another method used in the prior art was that of putting a wedge between the carburetor and the intake manifold so that the fuel level will be horizontal with respect to the jets on the turns and thereby provide the same pressure level to each jet. However, on the straightaway, the level of fuel is higher with respect to one of the jets than the other so that the fuel pressures with respect to the two jets are different.

SUMMARY OF THE INVENTION

The present invention provides a removable manifold in each reservoir connecting the jets, which are on a horizontal plane to the approximate center of the reservoir so that the fuel supply to the manifold and the jets is substantially constant so as to distribute a generally equalized fuel flow to both jets regardless of the angle of the fuel in the reservoir or bowl.

The jets are arranged to have their heads extend into the reservoir and are screwed into the carburetor to each supply fuel to the individual carburetor barrels. In racing cars, the jets are frequently changed so as to vary the sizes and the amount of fuel flow to the carburetor, depending upon climatic and other conditions.

The removable manifold according to the invention is adapted to fit over the heads of the jets in the reservoir. It may be fitted on the heads by a snap fit or may be secured thereon with a set screw. It is easily inserted or removed when the jets are changed.

It is an object of the invention to provide a removable manifold for supplying a generally equalized fuel flow to each jet regardless of the angle of the fuel in the reservoir. The manifold has a single inlet which distributes unrestricted fuel flow to each jet.

The removable manifold may be made of polyvinyl chloride in one piece or may be of flared metal tubing, for example, where two flared ends are secured over the jet ends and there is a single inlet opening centrally spaced between the ends to provide fuel flow through the tubing to the jets.

In back to back multiple lap tests on a third of a mile track, average lap time at full speed without the use of the present invention was 16.86 seconds, and in the same car at full speed with the use of the present invention the average lap time was 16.64 seconds. In a 40 lap race, this speed increase with the present invention amounts to a half lap gain over the same car without the invention.

The present invention, as usually installed, requires no modification of a typical racing carburetor.

Further objects and advantages of the invention may be brought out in the following part of the specification wherein small details have been described for the competence of disclosure, without intending to limit the scope of the invention which is set forth in the appended claims.

BRIEF DESCRIPTION OF THE DRAWINGS

Referring to the accompanying drawings, which are for illustrative purposes:

FIG. 1 is a perspective view of a four barrel carburetor showing the four barrels fragmentarily in an exploded view position;

FIG. 2 is an elevational view of a plate of the carburetor which forms the inner wall of the fuel reservoir, taken along the lines 2—2 in FIG. 1;

FIG. 3 is a cross-sectional view of the carburetor reservoir and the wall shown in FIG. 2;

FIG. 4 is a perspective outer view of a removable manifold according to the invention;

FIG. 5 is a perspective inner view of the invention shown in FIG. 4;

FIG. 6 is a cross-sectional plan view, taken along the lines 6—6 in FIG. 4; and FIG. 7 is a cross-sectional view, taken along the lines 7—7 in FIG. 4.

DESCRIPTION OF THE PREFERRED EMBODIMENTS

Referring again to the drawings, there is shown in FIG. 1 the upper portion of a four barrel carburetor, generally designated as 10, having an air inlet 12, and a closed fuel reservoir 14 on one side of the inlet and an identical reservoir 16 on the other side of the inlet. Spaced below the inlet and adapted to be secured to its lower end is a fragmentary view of a plate 18 showing four openings 20 into which the four barrels of the carburetor extend.

The reservoir 14 is attached to a plate or wall 22 which is shown in FIG. 2 with the reservoir removed. In FIG. 3 a cross-sectional view of the plate 22 and the reservoir 14 are shown. The reservoir is supplied with liquid fuel, such as gasoline, through a needle valve, not shown. The needle valve is operated by a float 26 which is pivotally mounted at 28 on the wall 30 so as to maintain the fuel at an adequate volume. When the carburetor is horizontal the fuel is at a generally horizontal level at 32. As the fuel is used, the float pivots downwardly to open the needle valve, and when the reservoir is filled to the highest required level the float raises so as to close the needle valve.

Through an outer surface 36 of the wall 22 extend two threaded openings 38 and 40 on a horizontal plane into which jets 42 and 44, respectively, are threadedly engaged. The jets have a selected size orifice 46 and have a head 48 by which they are rotated into and out of the threaded openings. The heads extend outwardly of the surface 36 to provide for easy insertion and removal of the jets. The fuel flows through the orifice 46 of the jet 42 into a passage 50 in the wall 22 and then through an orifice 52 into a venturi of one barrel of the carburetor. Through the orifice 46 in the jet 40, fuel similarly flows through a passage 52, FIG. 3, to a second barrel of the carburetor. The foregoing described fuel flow into the carburetor barrels occurs with or without the use of the removable manifold, according to the invention, which is generally designated as 60 in FIGS. 2–7.

The removable manifold or encapsulating means 60 is generally oblong in shape. Its outer wall 62 has a central inlet opening 64 to an inner horizontal passage 66 which terminates at opposite closed ends where it is open to outlets 68 and 70 in an inner wall 72. One end 74 has a threaded opening which is closed by an Allen set screw 76.

The upper surface of the removable manifold has a curved recess 78 for fitting on the wall 22. There is an opening 82 in the inner wall 72 for fitting over a locater pin, not shown, extending outwardly of the wall 22. The openings 68 and 70 are adapted to fit snugly on the jet heads 48, as shown in FIGS. 2 and 3, and the wall 72 fits snugly on the surface 36 to encapsulate. The set screw 76 is tightened against the head 48 to secure the removable manifold in place. If the manifold is made out of sufficiently resilient polyvinyl chloride, for example, it may be secured in place by merely a snap fit on the heads.

During racing on an oval track, the level of the fuel in the reservoir is moved into many positions according to the centrifugal force caused by the movement of the car around the oval track. Some of these levels are indicated in FIG. 2 in broken lines 86, 88, 90 and 92. As the liquid is moved into such positions, the fuel pressure on the respective jets is varied according to the height of the liquid so as to cause less fuel to flow into the jet from the lower level than from the higher level when the present invention is not in place. As may be visualized in FIG. 2, the fuel that enters the inlet 64 is supplied in a generally equalized unrestricted flow to each jet at all times regardless of the angle of the fuel in the reservoir. This tends to eliminate the leanness of mixture from the jet where the level is low, and richness in the mixture from the jet where the level is higher. By having the mixtures in all barrels the same, the greater efficiency and speed indicated above is achieved.

The invention and its attendant advantages will be understood from the foregoing description and it will be apparent that changes may be made in the form, construction and arrangements of the parts of the invention without departing from the spirit and scope thereof or sacrificing its material advantages, the arrangements hereinbefore described being merely by way of example. We do not wish to be restricted to the specific forms shown or uses mentioned except as defined in the accompanying claims.

We claim:

1. In a carburetor, a liquid fuel reservoir connected to the carburetor for supplying fuel therefor, a plurality of spaced identical jets on a horizontal plane adjacent the bottom of the reservoir and having jet ends connected to the reservoir and connected to parts of the carburetor to provide horizontal fuel flow passages directly to the carburetor from the reservoir, the improvement comprising:

removable encapsulating means surrounding jet ends in said reservoir so that the flow of fuel through said identical jets is generally equalized regardless of the angle of the fuel level, said encapsulating means having a first opening to said reservoir, and having a flow passage from said first opening to said jets, said removable encapsulating means is an elongated member extending between and around said jet ends in said reservoir, said member being formed with a pair of spaced second openings communicating with said flow passage adapted to snap fit on the jet ends so as to be secured thereon.

2. The invention according to claim 1 in which:

said member is made of resilient plastic.

3. The invention according to claim 1 in which:

said jets are connected to said carburetor through a wall forming a face of said reservoir, and said removable encapsulating member snugly engages said face of said reservoir when snap fitted into place.

4. The invention according to claim 1 including:

a set screw extending through and being threadedly engaged in said removable encapsulating means to abut one of said jets to further secure said member on said jet ends.

5. The invention according to claim 4 in which:

said second openings are adjacent opposite ends of said member, and said first opening is spaced between said opposite ends.

* * * * *